US010258082B2

(12) United States Patent
Süss et al.

(10) Patent No.: US 10,258,082 B2
(45) Date of Patent: Apr. 16, 2019

(54) TOBACCO POUCH

(71) Applicant: REEMTSMA CIGARETTENFABRIKEN GMBH, Hamburg (DE)

(72) Inventors: Daniel Süss, Hamburg (DE); Carmen Bühr, Hamburg (DE)

(73) Assignee: REEMTSMA CIGARETTENFABRIKEN GMBH, Hamburg (DE)

( * ) Notice: Subject to any disclaimer, the term of this patent is extended or adjusted under 35 U.S.C. 154(b) by 242 days.

(21) Appl. No.: 14/912,891

(22) PCT Filed: Aug. 12, 2014

(86) PCT No.: PCT/EP2014/067206
§ 371 (c)(1),
(2) Date: Feb. 18, 2016

(87) PCT Pub. No.: WO2015/032594
PCT Pub. Date: Mar. 12, 2015

(65) Prior Publication Data

US 2016/0198764 A1 Jul. 14, 2016

(30) Foreign Application Priority Data

Sep. 5, 2013 (EP) ..... 13183179

(51) Int. Cl.
*B65D 85/10* (2006.01)
*A24F 23/02* (2006.01)
(Continued)

(52) U.S. Cl.
CPC ..... *A24F 23/02* (2013.01); *B65D 33/18* (2013.01); *B65D 33/2508* (2013.01)

(58) Field of Classification Search
CPC ..... A24F 23/02; B65D 33/18; B65D 33/2508
(Continued)

(56) References Cited

U.S. PATENT DOCUMENTS 2,537,196 A * 1/1951 Tanski ..... A24F 23/02 206/205
3,088,652 A * 5/1963 Berven ..... B65D 31/12 206/0.5
(Continued)

FOREIGN PATENT DOCUMENTS

DE 102004056043 A1 5/2006
DE 102006050387 A1 4/2008
(Continued)

OTHER PUBLICATIONS

Office Action of Corresponding Russian Application 2016108138/12 dated Oct. 18, 2017, 11 pages.
(Continued)

*Primary Examiner* — Luan K Bui
(74) *Attorney, Agent, or Firm* — Workman Nydegger

(57) ABSTRACT

A tobacco pouch with a front panel and a back panel, which are connected with one another via a first folding line at a first lateral edge, via a first connecting means at a second lateral edge, and via a second connecting means at a lower edge, a strip-shaped, openable first closure running along an upper edge from the first folding line to the first connecting means, sealing an opening, and at least one strip-shaped, openable second closure located in between the first closure and the second connecting means and miming from the first folding line up to the first connecting means, dividing the inside of the tobacco pouch into at least two chambers.

17 Claims, 3 Drawing Sheets

Figure 1:
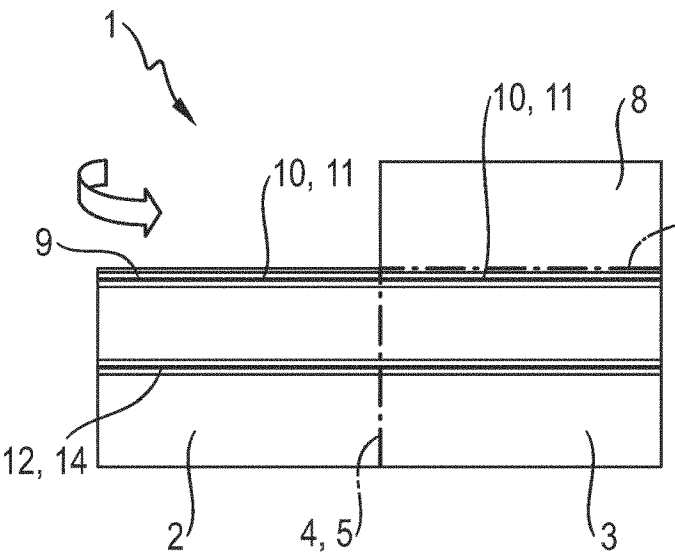

(51) Int. Cl.
*B65D 33/18* (2006.01)
*B65D 33/25* (2006.01)

(58) Field of Classification Search
USPC ..... 206/242, 245, 260; 383/37–40, 43, 61.2, 383/63, 85, 86
See application file for complete search history.

(56) References Cited

U.S. PATENT DOCUMENTS

| | | | | |
|---|---|---|---|---|
| 4,637,061 | A * | 1/1987 | Riese | B65D 31/12 206/219 |
| 4,786,190 | A * | 11/1988 | Van Erden | B65D 33/20 206/260 |
| 5,116,301 | A | 5/1992 | Robinson | |
| 5,352,041 | A * | 10/1994 | Fullerton | B65D 33/34 383/38 |
| 6,767,131 | B2 * | 7/2004 | Taheri | B65D 33/2541 383/102 |
| 6,929,127 | B1 * | 8/2005 | Delk, Sr. | B42F 5/00 206/0.84 |
| 7,556,429 | B2 * | 7/2009 | Taheri | B65D 31/12 383/38 |
| 2002/0067865 | A1 * | 6/2002 | Stutzman | B65D 31/12 383/38 |
| 2008/0107781 | A1 | 5/2008 | Caroll | |
| 2009/0142006 | A1 | 6/2009 | Wine | |
| 2011/0210163 | A1 | 9/2011 | Clark | |
| 2011/0284550 | A1 * | 11/2011 | Gersovitz | B65D 1/04 220/524 |
| 2012/0321224 | A1 * | 12/2012 | Zamski | B65D 31/12 383/38 |

FOREIGN PATENT DOCUMENTS

| | | | |
|---|---|---|---|
| DE | 202009013506 | | 2/2010 |
| EP | 0452167 | | 10/1991 |
| EP | 0452167 | A1 | 10/1991 |
| EP | 1017593 | B1 | 2/2002 |
| FR | 1487955 | A | 7/1966 |
| FR | 1487955 | | 7/1967 |
| FR | 1487955 | A | 7/1967 |
| FR | 3003545 | | 3/2013 |
| GB | 921980 | | 3/1963 |
| GB | 2191938 | | 12/1987 |
| GB | 2447958 | | 10/2008 |
| JP | 42-3545 | | 3/1967 |
| JP | 63-24879 | A | 2/1988 |
| JP | 63-134932 | | 9/1988 |
| JP | 5-82855 | | 11/1993 |
| JP | 11342958 | A | 12/1999 |
| JP | 2003-081286 | A | 3/2003 |
| JP | 2004-035103 | A | 2/2004 |
| JP | 2012-516816 | A | 7/2012 |
| JP | 2013-521195 | A | 6/2013 |
| WO | 2010/088492 | A1 | 8/2010 |

OTHER PUBLICATIONS

International Search Report and Written Opinion for PCT Application No. PCT/EP2014/067206, dated Mar. 19, 2015.
Office Action of corresponding Taiwan Patent Application 10328767, 16 pages.
Examination Report for Australian Patent Application 2014317360 dated Jan. 31, 2018, 3 pages.
Office Action in Corresponding JP Application 2016-539457 dated Jun. 4, 2018, 13 pages.

* cited by examiner

TOBACCO POUCH

CROSS REFERENCE TO RELATED APPLICATIONS

This application is a U.S. Nationalization of PCT Application Number PCT/EP2014/067206, filed on Aug. 12, 2014, which claims priority to EP Patent Application No. 13183179.4, filed on Sep. 5, 2013, the entireties of which are incorporated herein by reference.

The invention concerns a tobacco pouch.

Tobacco pouches serve the purpose of storing loose tobacco, in order to roll individual cigarettes from it if required. These days, tobacco pouches are produced by machine in large quantities, from plastic film. They have a front panel and a back panel, which are connected with one another at the edge along a folding line and/or along sealed seams. At the edge of an opening they have usually a flap, which can be connected to the front panel or the back panel with the aid of a resealable adhesive strip. The flap prevents tobacco, as well as moisture and flavourings, from seeping out.

DE 20 2009 013 506 U1 describes a package designed as a tobacco pouch, which is constructed from at least two respective partial packages designed as pouches. The partial packages are connected with one another via their lateral edges, and the dimensions of the partial packages are in total equal to the dimensions of monobloc packages. Along a perforation line in the lateral edges, the partial packages can be separated from one another. The package requires less packaging material than conventional tobacco pouches, which are used to pack quantities of tobacco of different sizes. In that respect, the package may be processed on the same packing machines as the well-known packages. Disadvantageous, however, are the short openings, which make it difficult to take out tobacco. In addition, the short flaps are not suitable as a base for pre-forming a roll of tobacco having the length of a cigarette.

Taking the latter as a starting point, it is the object of the invention to create a tobacco pouch which, based on using a small amount of packaging material, makes it possible to store separately various same or different quantities or blends of tobacco, has a conventional format, keeps the tobacco longer fresh and makes it easier for the user to handle the tobacco pouch and the tobacco prior to creating individual cigarettes.

The object is solved by means of a tobacco pouch having the features of claim 1. Advantageous embodiments of the tobacco pouch are given in the sub-claims.

The tobacco pouch made of film material in accordance with the invention has a front panel and a back panel, which are connected with one another via a first folding line at a first lateral edge, via a first connecting means at a second lateral edge, and via a second connecting means at a lower edge, a strip-shaped, openable first closure running along an upper edge from the first folding line to the first connecting means, sealing an opening, and at least one strip-shaped, openable second closure located in between the first closure and the second connecting means and running from the first folding line up to the first connecting means, dividing the inside of the tobacco pouch into two chambers.

The tobacco pouch in accordance with the invention has a first closure at the upper edge, which seals an opening to the inside of the tobacco pouch and prevents tobacco, as well as moisture and flavourings, from seeping out. In addition, the tobacco pouch has at least one second closure, which divides the inside of the tobacco pouch into at least two chambers. Once the first closure has been opened, initially the tobacco can be taken out of the first chamber arranged next to the first closure. The tobacco in the second chamber, further removed from the first closure, is, moreover, protected from moisture and flavourings seeping out. In the second chamber, the tobacco is also freshly available if the first chamber is emptied over a longer period of time. Once the first chamber has been emptied, the second chamber can be accessed from the outside through the first chamber to take out tobacco by opening the second closure. Should the tobacco pouch have several second closures, several second chambers can be opened, one after the other, once the previous chamber has been emptied. The tobacco pouch preferably has a total of two chambers. Since the chambers run parallel to the upper edge, the entire or nearly the entire length of the upper edge is available for taking out tobacco. This facilitates the process of the user placing the loose tobacco ready for making a roll of tobacco, which has the usual length of a cigarette. Additionally the pouch can be folded into a smaller sized pouch. Conventional machines can be used to produce the tobacco pouch, conventional secondary packaging can be used to pack the tobacco pouch and conventional sales aids can be used to present the tobacco pouch. To fill up the tobacco pouch prior to closing the first closure, the entire length of the opening at the upper edge can be used. Conventional machines can be utilised for this purpose.

Preferably, the first closure and/or the second closure is a sealed seam or a bond seam or a zip or a hook and loop fastener or a microsuction structure. The zip is preferably a plastic zip. Hook and loop-fasteners suitable for use in the present invention are commercialized under the brand Velcro® by the company Velcro GmbH. Microsuction structures suitable for use in the present invention are commercialized under the brand Yupo Tako® by the company Yupo Europe GmbH.

The first folding line is provided in a continuous film material constituting the front panel and the back panel. In a first alternative, the first folding line is a sharp line manufactured by pressing adjacent portions of the continuous film material along a straight flat line together. In a second alternative, the first folding line is a bending line manufactured by bending adjacent portions of the continuous film material along a straight line without pressing them together.

According to a preferred embodiment, the strip-shaped first closure and/or the strip-shaped second closure is straight. Alternatively, the strip-shaped first closure and/or the strip-shaped second closure is curved or follows a zig-zag path or a sinusoidal path or any other suitable path.

According to a preferred embodiment, the tobacco pouch has a flap, which is connected to the upper edge of the back panel via a second folding line. Through the flap, the tobacco pouch is closable after opening one or more chambers. In addition, the flap can be used for placing material ready for making a cigarette roll. After emptying at least one chamber, the part of the front panel and of the back panel delimiting this chamber with the adhering flap can be wrapped around at least one still filled or partially filled chamber of the tobacco pouch, in order to seal the latter.

The second folding line is provided in a continuous film material constituting the flap and the back panel. In a first alternative, the second folding line is a sharp line manufactured by pressing adjacent portions of the continuous film material along a straight flat line together. In a second alternative, the second folding line is a bending line manufactured by bending the adjacent portions of the continuous film material along a straight line without pressing them together.

According to a preferred embodiment, the flap is also connected to the front panel or the back panel at a distance from the second folding line by means of an openable third closure.

According to a further embodiment, the third closure is a reclosable closure. According to a further embodiment, the third closure is an adhesive strip or a zip or a hook and loop fastener or a microsuction structure. Preferably, the adhesive strip is permanently glued to the flap and is glued with a reusable adhesive, or one that is sensitive to pressure, to the front panel or the back panel. The zip is preferably a plastic zip.

According to a further embodiment, the first connecting means at the second lateral edge is a sealed seam or a bond seam or a zip or a hook and loop-fastener or a microsuction structure or a third folding line connecting the front panel and the back panel with one another. Given that the tobacco pouch is manufactured from continuous web-shaped film material, the first connecting means is preferably a sealed seam. Given that the tobacco pouch is made of continuous web-shaped tubular material, the first connecting means is preferably a third folding line Like the first folding line, the third folding line is alternatively a sharp line or a bending line as set out above.

According to a further embodiment, the second connecting means at the lower edge is a sealed seam or a bond seam or a zip or a hook and loop fastener or a microsuction structure connecting the front panel and the back panel with one another.

According to a further embodiment, the first closure and/or the at least one second closure is a non-reclosable closure, so that it is not reclosable after breaking the closure open.

According to a further embodiment, the first closure is a reclosable closure. The reclosable first closure seals off the tobacco pouch, and prevents the loss of tobacco, moisture and flavourings in a particularly effective way. According to a preferred embodiment, the first closure is a plastic zip.

According to a further embodiment, the second closure is an adhesive bond that can be broken open between the front panel and the back panel. Once the adhesive bond has been broken open, it loses its effectiveness, so that the second closure cannot be closed again. If the tobacco pouch is designed involving a reclosable first closure, this can be used to prevent the tobacco in the second chamber from being lost.

The invention includes possible embodiments in the case of which the first closure is an adhesive bond that can be broken open, that is not reclosable. With this embodiment, it is preferable if it is reclosable by means of a reclosable flap.

According to a further embodiment, said at least one second closure divides the inside of the tobacco pouch into several chambers of equal size, so that the consumer can be provided with the same quantity of tobacco in each chamber.

According to a further embodiment, the flap has two flap segments, wherein a first flap segment is connected with the back panel via the second folding line, and a second flap segment with the front panel via a third folding line, the two flap segments being connected with one another at the first lateral edge via the first folding line and/or at the second lateral edge via the first connecting means and/or at their edge opposite the second folding line via a third connecting means. This embodiment is provided with a flap consisting of two flap segments. If the two flap segments are not connected with one another at at least one edge, the flap can be used for storing a cigarette paper booklet or another article between the two flap segments. The same goes, if the flap segments are connected with one another at each of the edges and provided with an openable closure, i.e. a perforation line.

According to a further embodiment, the third connecting means is a sealed seam or a bond seam or a zip or a hook and loop-fastener or a microsuction structure.

According to further embodiment, at least one perforation line is located in the front panel and/or in the second flap segment. If the perforation line is located in the front panel, the user can take tobacco out of the first or second chamber after opening the perforation line. If the perforation line is located in the second flap segment, the flap can store a cigarette paper booklet or other article which is removable after opening the perforation line. The user will have to open the first and second closures for removing tobacco from the chamber. Once tobacco has been taken out, the tobacco pouch can be closed by closing the flap and, if applicable, closing the first closure.

According to one embodiment, the tobacco pouch is manufactured from a cut-off section of a continuous, web-shaped film material. According to a further embodiment, the tobacco pouch is manufactured from a cut-off section of a continuous, tubular film material. The tubular film material may be made into at least a web-shaped film material by being divided, and tobacco pouches made from it.

According to a preferred embodiment, the tobacco pouch is made of completely or partially heat sealable film material. According to a further embodiment, the film material is a plastic or a paper or a metal film material or any combination of said materials. According to a further embodiment, the film material is a multilayer material comprising two or more different plastic or metal or paper layers or any combination of said layers. A multi-layer film material may have an inner layer made of a material that is inert in relation to tobacco and has the desired impermeability. An outer layer may be manufactured from a material that is well suited for printing. Furthermore, at least one of the materials is heat sealable. The film material is e.g. a multilayer material comprising an OPP (oriented polypropylene) and a PE (polyethylene) layer. Preferably, the multilayer material is a laminate. The plastic film material is e.g. a metalised film material. According to a further embodiment, the film material is a bioplastic film material. According to a further embodiment, the film material is a bio-degradable film material.

Plastic strips suitable for use in the present invention are described in EP 1 017 593 B1.

The sealed seams are manufactured by two film materials being fused with one another by increased temperature and pressure being applied, at least on the surface, and subsequently being cooled again. A permanent firm connection is generated in this way.

The adhesive for producing an adhesive bond that can be broken open is preferably an adhesive of a peelable seal. The adhesive bond that can be broken open can be produced by temporarily increasing the temperature and pressing the areas of the front panel and the back panel that have been smeared with adhesive together.

Figure 2:
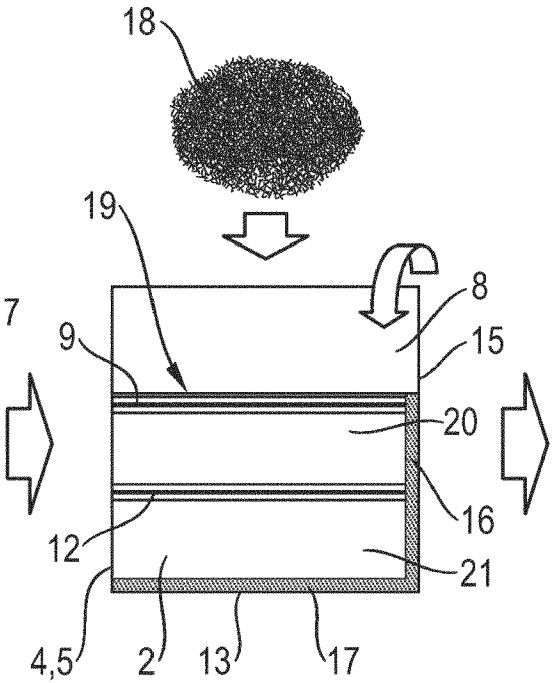
Figure 3:
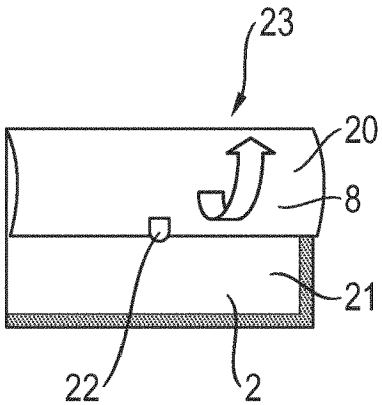
Figures 4, 5, 6:
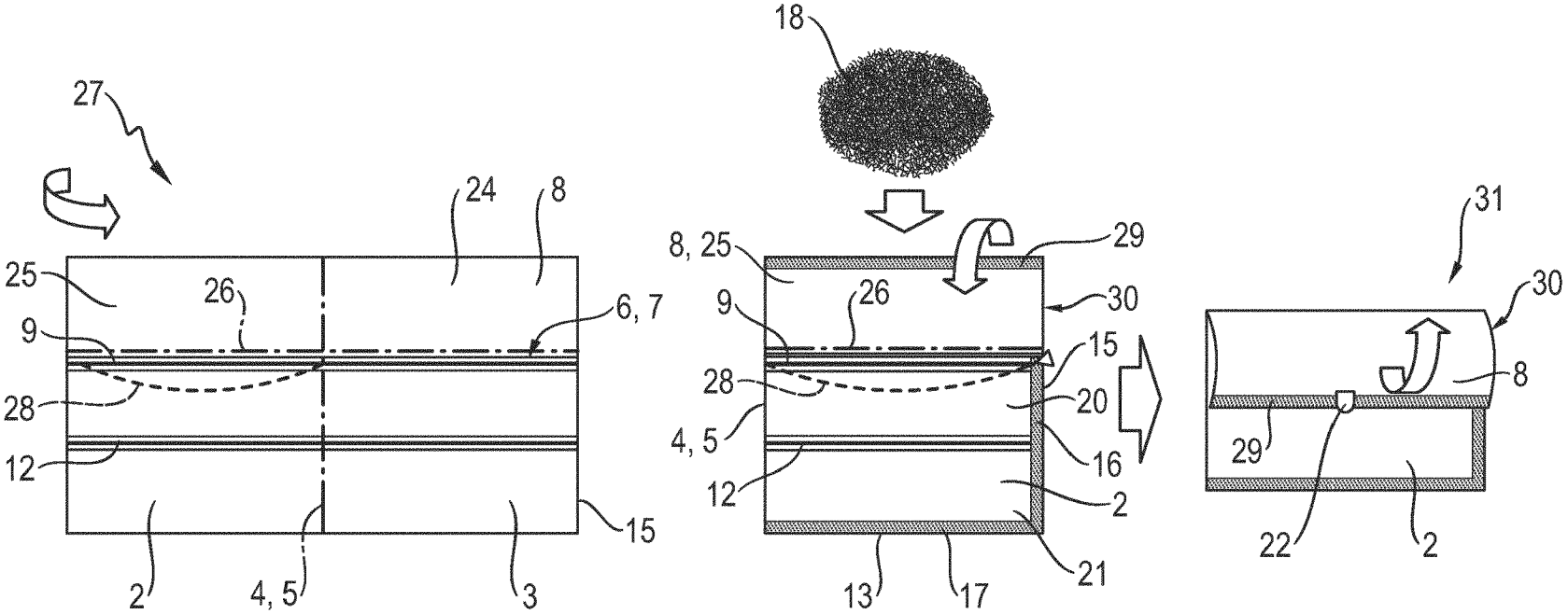
Figures 7, 8, 9:
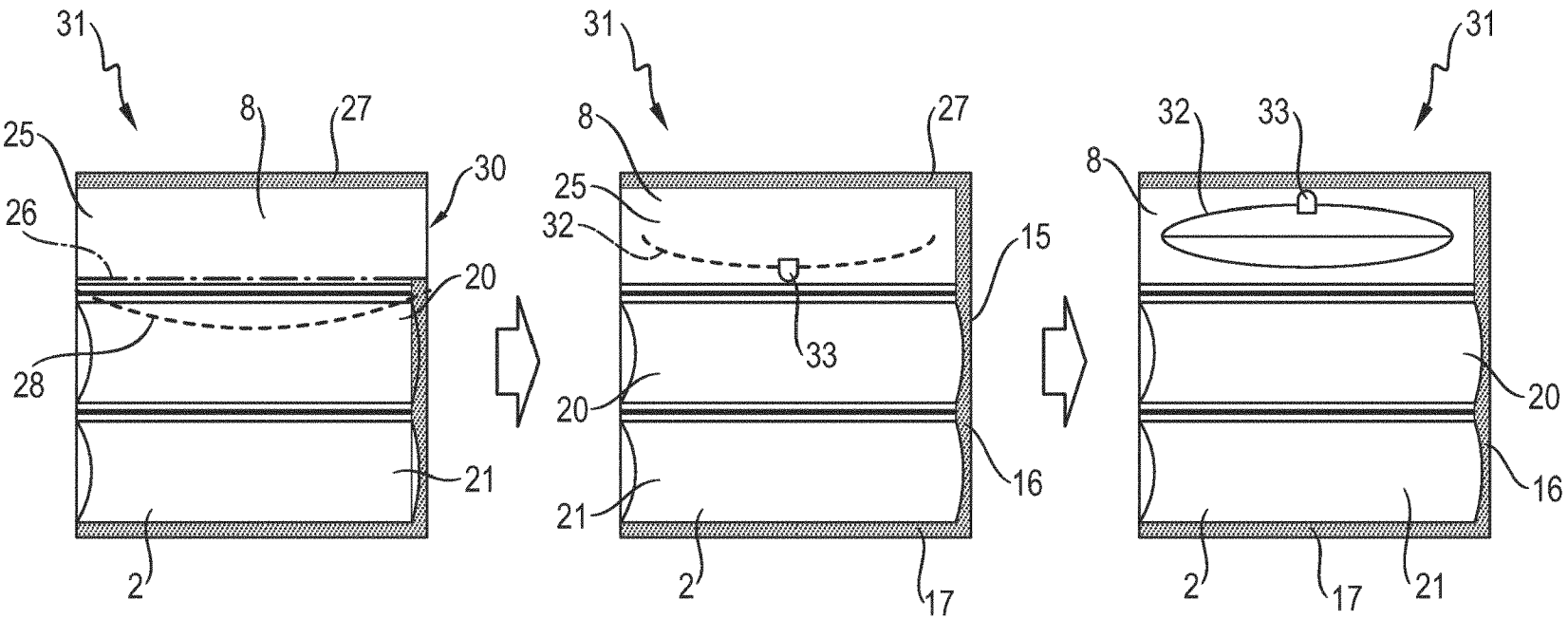

The invention is explained below based on the attached drawings of the second embodiments. The following are shown in the drawings:

FIG. 1 A front view of a blank of a first embodiment spread out flat;

FIG. 2 A front view of the pre-cut section when being filled with tobacco;

FIG. 3 A front view of the finished tobacco pouch;

FIG. 4 A front view of a blank of a second embodiment, spread out flat;

FIG. 5 A front view of the partially assembled blank when being filled with tobacco;

FIG. 6 A front view of the completely assembled tobacco pouch;

FIG. 7 A front view of the tobacco pouch with an opened flap:

FIG. 8 A front view of a third embodiment with an opened flap:

FIG. 9 A front view of the tobacco pouch with an opened perforation line.

According to FIG. 1, a blank 1 comprises a front panel 2 and a back panel 3, which are linked at a first lateral edge 4 via a first folding line 5. At an upper edge 6, a flap 8 is hinged to the back panel 3 via a second folding line 7.

Moreover, a strip-shaped, openable first closure 9 is attached to the inside of the front panel 2 and the back panel 3 along the upper edge 6. The latter concerns either an adhesive for producing an adhesive bond 10 that can be broken open or the two plastic zip components of a plastic zip 11.

Furthermore, the blank 1 features a strip-shaped, openable second closure 12, which extends in the middle between the upper edge 6 and a lower edge 13 of the front panel 2 and the back panel 3 over the entire width of the latter. The second closure 12 is preferably designed as an adhesive bond 14 that can be broken open.

According to FIG. 2, the front panel 2 is folded around the first folding line 5 against the back panel 3, and the front panel 2 and the back panel 3 are connected with one another at the second lateral edge 15 and at the lower edge 13 by first and second connecting means 16, 17. The connecting means are 16, 17 generated by applying a high temperature and pressure.

Afterwards, the tobacco 18 is filled in from above through the opening 19 between the first folding line 5 and the first connecting means 16. The tobacco 18 is distributed evenly over the area between the second connecting means 17 and the first closure 9. The first and second closures 9, 12 are thereafter closed by applying heat and temperature. The tobacco 18 is then distributed evenly over two chambers 20, 21, which are delimited by the first and second closures 9, 12.

Finally, the flap 8 is flipped and closed by means of a third closure 22 consisting of an adhesive strip, provided with adhesive that is sensitive to pressure on its inner surface, which is applied to the front panel 2 (FIG. 3).

To take tobacco 18 out of the tobacco pouch 23, the third closure 22 is detached and the flap 8 opened. Once the first closure 9 has been opened, the first chamber 20 is accessible. After taking tobacco 18 out of the first chamber 20, the latter or the flap 8 is closed again. Once the first chamber 20 has been emptied, the second chamber 21 is opened by opening the second closure 12. The second chamber 21 can also be closed by closing the first closure 9 or the flap 8 again, until all the tobacco 18 has been taken out.

The embodiment of FIGS. 4 to 7 differs from what has been described above by the flap 8 having a first flap segment 24, which is connected to the back panel 3 via the second folding line 7, and a second flap segment 25, which is connected to the front panel 2 via a third folding line 26. The blank 27 is rectangular, unlike blank 1, which has a punched-out area above the front panel 2. A perforation line 28 is provided using laser technology. The first and the second flap segments 24, 25, are, moreover, connected with one another via the first folding line 5.

Once the portions have been folded around the first folding line 5, the front panel 2, and the back panel 3 are connected with one another at the second lateral edge 15 via the first connecting means 16 and at the lower edge 13 via the second connecting means 17.

Afterwards, the tobacco 18 is filled in from above through the opening between the first and the second flap segments 24, 25 (FIG. 5). The tobacco 18 is distributed evenly over the area between the second connecting means 17 and the first closure 9. The first and second closures 9, 12 are then closed, and the upper edges of the first and second flap segments 24, 25 connected with one another by means of a third connecting means 29. A cigarette paper booklet is inserted through further opening 30 into flap 8. Finally, the double-layer flap 8 is folded against the front panel 2, and fixed there by means of a third closure 22.

According to FIG. 7, in order to take out the tobacco 18, the flap 8 is folded up against the tobacco pouch 31, and the perforation line 28 separated off. As a result, the user has access to the tobacco 18 in the first chamber. The cigarette paper booklet is accessible through further opening 30.

The embodiment of FIGS. 8 and 9 differs from the embodiment of FIGS. 4 and 7 in that a perforation line 32 is provided in the second flap segment 25. Further, a first connecting means 16 extends along second lateral edge 15 up to a third connection means 29. Finally, adhesive strip 33 facilitates opening of a perforation line 32.

After opening a perforation line 32, a cigarette paper booklet can be removed from flap 8. Chambers 20 and 28 are accessible after opening a first closure 9 and second closure 12. After removing tobacco and cigarette paper, a user can reinsert the paper booklet into flap 8 and close it by adhering adhesive tape 33 to second flap segment 25 adjacent first closure 9.

1 blank
2 front panel
3 back panel
4 first lateral edge
5 first folding line
6 upper edge
7 second folding line
8 flap
9 first closure
10 adhesive bond
11 plastic zip
12 second closure
13 lower edge
14 adhesive bond
15 second lateral edge
16 first connecting means
17 second connecting means
18 tobacco
19 opening
20 chamber
21 chamber
22 third closure
23 tobacco pouch
24 first flap segment
25 second flap segment
26 third folding line
27 blank
28 perforation line
29 third connecting means
30 further opening

31 tobacco pouch
32 perforation line
33 adhesive tape

The invention claimed is:

1. A tobacco pouch with a front panel and a back panel, which are connected with one another via a first folding line at a first lateral edge, via a first connecting means at a second lateral edge, and via a second connecting means at a lower edge, a strip-shaped, openable first closure running along an upper edge from the first folding line to the first connecting means, sealing an opening, and at least one strip-shaped, openable second closure located in between the first closure and the second connecting means and running from the first folding line up to the first connecting means, dividing the inside of the tobacco pouch into at least two chambers, wherein the pouch further comprises a flap, wherein said flap is formed from a single segment connected to the upper edge of the back panel via a second folding line and overlaps the first closure and an upper portion of the front panel when in a closed position.

2. The tobacco pouch in accordance with claim 1 made completely or partially of heat sealable film material.

3. The tobacco pouch in accordance with claim 1, wherein the flap has a width and height selected to provide a support base for pre-forming a roll of tobacco having the length and circumference of a cigarette.

4. The tobacco pouch in accordance with claim 1, wherein the flap is closable against the front panel or the back panel at a distance from the second folding line by means of an openable third closure.

5. The tobacco pouch in accordance with claim 4, wherein the third closure is a reclosable closure.

6. The tobacco pouch in accordance with claim 4, wherein the third closure is an adhesive strip or a zip or a hook and loop fastener or a microsuction structure.

7. The tobacco pouch in accordance with claim 1, wherein the first connecting means is a sealed seam or a third folding line connecting the front panel with the back panel.

8. The tobacco pouch in accordance with claim 1, wherein the first closure and/or the at least one second closure is a non-reclosable closure.

9. The tobacco pouch in accordance with claim 8, wherein said first closure and/or said at least one second closure is an adhesive bond that can be irreversibly broken open connecting the front panel and the back panel.

10. The tobacco pouch in accordance with claim 1, wherein the first closure is a reclosable closure.

11. The tobacco pouch in accordance with claim 10, wherein the first closure is a zip or a hook and loop fastener or a microsuction structure.

12. The tobacco pouch in accordance with claim 1, wherein said at least one second closure means divides the inside of the tobacco pouch into several chambers of the same size.

13. The tobacco pouch in accordance with claim 1, wherein at least one perforation line is located in the front panel.

14. The tobacco pouch in accordance with claim 13, wherein the perforation line is located adjacent the first closure means and extends in direction of first closure.

15. The tobacco pouch in accordance with claim 1, which is manufactured from a cut-off section of a continuous, web-shaped film material.

16. The tobacco pouch in accordance with claim 1, which is manufactured from cut-off sections of a continuous, tubular film material.

17. The tobacco pouch in accordance with claim 3, wherein the flap has a width of between about 70 mm and about 120 mm and has a height of between about 34 mm and about 88 mm.

* * * * *